United States Patent [19]

Glenn

[11] 4,343,282

[45] Aug. 10, 1982

[54] LIQUID TOWER CARBURETOR

[76] Inventor: Joseph G. Glenn, Rte. 1, Box 1221, Broken Arrow, Okla. 74012

[21] Appl. No.: 57,641

[22] Filed: Jul. 16, 1979

[51] Int. Cl.[3] ..... F02M 17/18

[52] U.S. Cl. ..... 123/523; 261/36 A; 261/78 A

[58] Field of Search ..... 123/523, 522, 558, 579; 261/36 A, 78 A, 64 A, DIG. 39

[56] References Cited

U.S. PATENT DOCUMENTS

| | | | |
|---|---|---|---|
| 890,970 | 6/1908 | Dun | 261/36 A |
| 1,021,079 | 3/1912 | Stewart | 123/523 |
| 1,296,116 | 3/1919 | Pfeifer | 123/522 |
| 1,465,514 | 8/1923 | Bannister | 123/523 |
| 2,285,905 | 6/1942 | Cunningham | 123/523 |
| 2,742,886 | 4/1956 | McPherson | 123/522 |
| 3,269,658 | 8/1966 | Gerquest | 261/36 A |
| 3,713,429 | 1/1973 | Dwyre | 123/522 |
| 4,007,238 | 2/1977 | Glenn | 261/78 A |
| 4,151,821 | 5/1979 | Wichman | 123/558 |

*Primary Examiner*—Ronald H. Lazarus

*Attorney, Agent, or Firm*—Head, Johnson & Stevenson

[57] ABSTRACT

A method and means for reducing fuel consumption in an internal combustion engine, or the like, and which comprises nebulization of fuel for injection into the usual automobile carburetor. The normal fuel nozzle of the carburetor is closed or removed and the nebulization system of the vapor tower is utilized to replace the function of the nozzle to provide a more efficient fuel utilization. The apparatus provides its own vacuum, and may be readily utilized with a turbo charge system, or the like, as well as the usual or normal carburation system.

11 Claims, 1 Drawing Figure

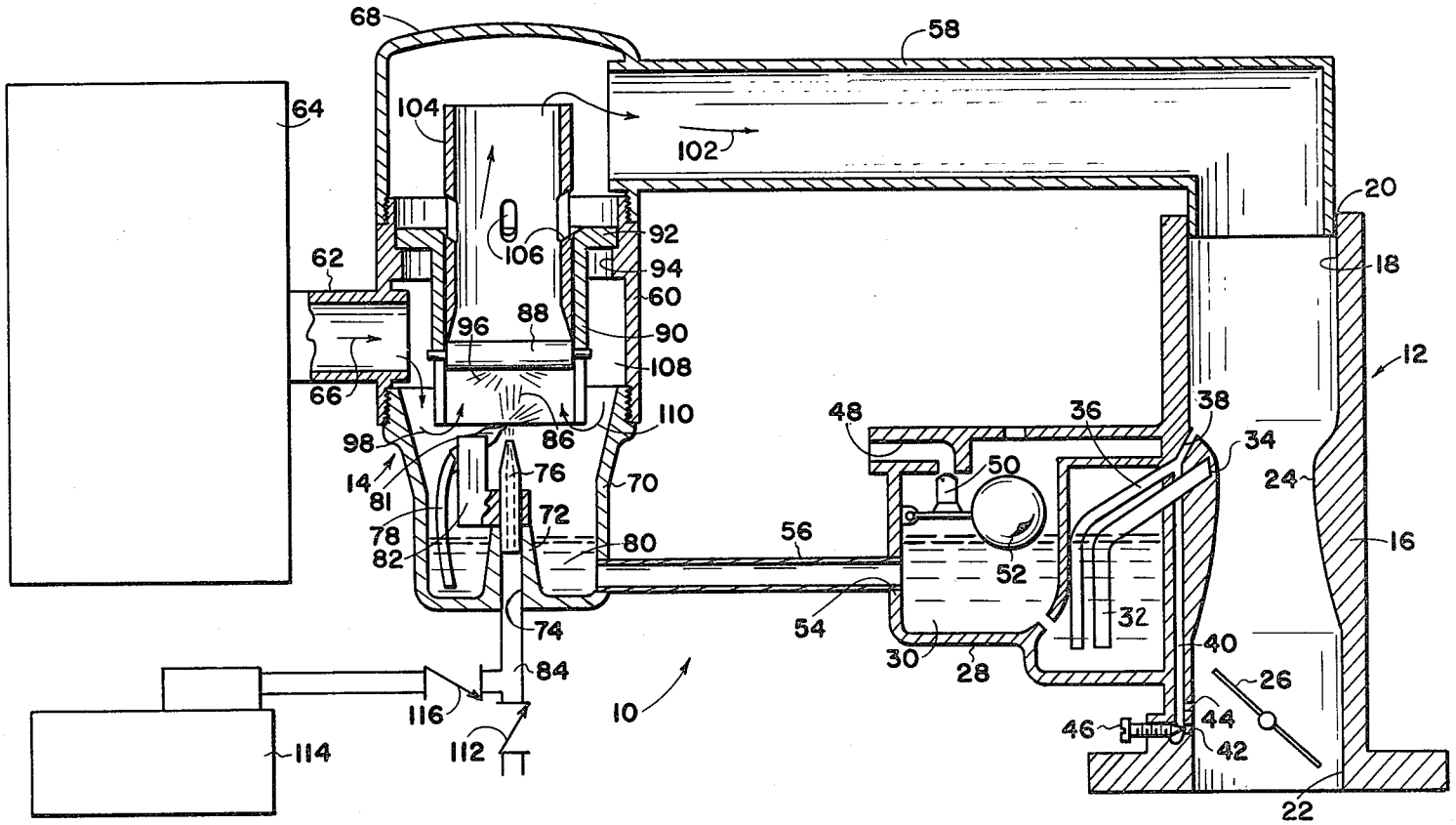
12
16
20
18
22
24
26
34
38
40
44
42
32
36
46
50
52
28
30
58
48
54
56
102
92
94
60
90
108
110
70
80
10
106
88
86
76
72
74
84
112
96
104
116
68
98
14
81
78
82
62
66
64
114

LIQUID TOWER CARBURETOR

BACKGROUND OF THE INVENTION

1. Field of the Invention

This invention relates to improvements in carburation systems and more particularly, but not by way of limitation, to a method and means for nebulization of fuel for injection into a carburetor.

2. Description of the Prior Art

In the usual internal combustion engine, or the like, the fuel is normally introduced into the carburetor for mixing with an air stream, and the fuel-air mixture is directed to the manifold and to the combustion chamber for burning. The carburetor operates on a simple physical principal wherein air drawn into the engine by the downward suction of a piston enters the top of the carburetor bore and travels downwardly therethrough, and through the venturi. A main fuel nozzle communicates between a bowl of fuel and the interior of the carburator in the proximity of the venturi, and as the air passes through the venturi, the speed of the flow stream increases and the pressure drops slightly in the venturi. The drop in pressure pulls the fuel from the fuel bowl for injection into the carburetor bore through the nozzle, whereupon the fuel mixes with the air stream, forming a fine spray of atomized particles. This air-fuel mixture passes through the carburetor into the intake manifold, whereupon the fuel-air mixture is distributed to the engine cylinders for compression and combustion.

It is recognized that one secret of fuel economy is directly related to the ratio of air to fuel, and the efficient vaporization of the fuel-air mixture prior to burning thereon in order to achieve a more complete burning of the fuel for efficient use of the fuel and reduction of pollutants released into the atmosphere. Many efforts have been and are being made to improve the fuel efficiency, particularly in light of the present day shortages of petroleum fuels. For example, a sonic apparatus has been developed wherein the fuel is disturbed by high-frequency energy for decomposition to the fuel to produce a substantial "cloud" of fuel. This reduction of fuel particles to such small sizes, and of relatively uniform particle size, increases the combustion efficiency. However, even with this improved procedure, there is still fuel loss and pollution resulting from unburned elements of the fuel.

SUMMARY OF THE INVENTION

The present invention contemplates a method and means for improving the carburation of fuel to an even greater extent than the foregoing, and comprises a nebulizer system, such as that shown in my prior U.S. Pat. No. 4,007,238, issued Feb. 8, 1977, and entitled "Nebulizer for Use with IPPB Equipment", utilized in lieu of the usual fuel nozzle normally provided in the carburetor of an automobile, or the like. The normal nozzle is either closed or removed, and the fuel is directed from the fuel bowl into the nebulizer for atomization prior to injection within the carburetor upstream of the venturi. Either the exhaust system of the engine, or a separate compressor may be utilized as a power source for operation of the nebulizer, and the efficiency of the atomization of the fuel stream moving through the nebulizer greatly improves the combustion of the air-fuel mixture, thus improving the fuel efficiency and reducing polution of the atmosphere. In addition, lower engine temperature is maintained during operation thereof, and the costs of the system are much less than presently available pneumatic systems, and particularly less than the sonic systems. Furthermore, fuel economy may be achieved by adding alcohol through the carburetor as opposed to the current practice of mixing the alcohol with the gasoline. The novel method and means of the invention is simple and efficient in operation and economical and durable in construction.

BRIEF DESCRIPTION OF THE DRAWING

The drawing is a sectional elevational view of a nebulizer carburetor system embodying the invention.

DESCRIPTION OF THE PREFERRED EMBODIMENT

Referring to the drawing in detail, reference character 10 generally indicates a liquid tower carburetor comprising a carburetor section 12 and a nebulizor section 14 in open communication therewith. The carburetor 12 comprises the usual housing or body 16 having a central bore 18 extending longitudinally therethrough and open at both ends 20 and 22 for a purpose as will be hereinafter set forth. The diameter of the bore 18 is reduced at 24 to provide a venturi within the housing 16 and is preferably disposed substantially centrally of the length of the bore 18, but not limited thereto. A suitable throttle valve 26 is disposed within the bore 18 and interposed between the venturi 24 and the open end 22 for controlling the flow of fuel through the bore 18. The throttle valve 26 is preferably operably connected with the usual accelerator pedal, or the like, (not shown) of the engine with which the apparatus 10 is utilized whereby the opening and closing of the valve 26 controls the amount of fluid which can pass through the bore 18. As the valve 26 opens, an increased fluid volume moves through the bore 18, and as the valve 26 closes, a decreased fluid volume moves through the bore 18, as is well known.

A second housing 28 is provided on the outer periphery of the housing 16, and may be integral therewith or secured thereto, as desired, to provide a fuel bowl for the carburetor 12, as is well known. For receiving a supply of fuel 30 therein, the carburetor 16 is usually provided with a conduit 32 having the outer end thereof open and extending into the fuel reservoir 30 and the inner end thereof open for discharge of the fuel into the bore 18. However, in the present invention, the inner end of the conduit 32 is closed as shown at 34 for closing the direct communication between the fuel reservoir 30 and the bore 18 for a purpose as will be hereinafter set forth. Of course, it is to be noted that the conduit 32 may be removed or completely eliminated, if desired, for closing the communication between the fuel 30 and the bore 18.

An auxliary conduit 36 is also provided in the carburetor 16, with the outer end thereof open to the fuel reservoir 30 and the inner end thereof open to a substantially radially extending passageway 38 provided in the wall of the housing 16, and disposed slightly upstream of the venturi 24. A longitudinally extending passageway 40 is provided in the sidewall of the housing 16 and extends from the passageway 38 to a radial bore 42 which extends through the sidewall of the housing 16 to provide communication between the exterior thereof and the bore 18. It may also be preferable to provide a plurality of spaced bores 44 in the housing 16 between bore 18 and the passageway 40 as is well known and for a purpose as will be hereinafter set forth. An adjustable nozzle element 46 extends into the bore 42 for adjusting the size of the opening therein for controlling the flow of fluid from the passageway 40 into the bore 18 as will be hereinafter set forth.

An inlet passageway 48 is provided in the upper portion of the second housing 28 and is in communication with the usual main fuel supply, such as the fuel tank of the engine or automobile (not shown) for supplying the fuel 30. A suitable control valve 50 is disposed at the open inner end of the passageway 48 for opening and closing thereof for controlling the quantity of fuel delivered to the reservoir 30. A float member 52 is disposed within the housing 28 for a normal floating position on the surface of the fuel 30, and is operably connected with the valve 50 in any suitable or well known manner for opening and closing of the valve in accordance with the level of the fuel 30, as is well known.

A discharge port 54 is provided in the housing 28 and disposed below the normal or desired level of the fuel 30. A pipe or conduit 56 is disposed in the port 54 or suitably connected therewith and extends into communication with the interior of the lower portion nebulizer 14 as viewed in the drawing. Since it is well known that a liquid seeks its own level, the fuel will be transmitted through the conduit 56 to the interior of the nebulizer at all times when the supply of fuel in the reservoir 30 is sufficient to assure that the upper level thereof is disposed above the port 54. The open end 20 of the bore 18 is also in communication with the interior of the nebulizer 14 at the upper portion thereof through a suitable pipe or conduit 58 for a purpose as will be hereinafter set forth.

As hereinbefore set forth, the nebulizer 14 is generally similar to that shown in my aforementioned patent, and comprises a housing 60 which is normally positioned with its axis vertical. A tube member 62 extends through the sidewall of the housing 60 and into communication with a suitable air source 64 whereby the air may be drawn into the interior of the housing in the direction indicated by the arrow 66. A cap portion 68 is threadedly or otherwise secured to the upper end of the housing 60, as viewed in the drawings, and closes the tip thereof. The conduit or pipe 58 is suitably connected with the cap member 68 and establishes communication between the interior of the cap 68 and the bore 18 as clearly shown in the drawing.

A cup member 70 is threadedly or otherwise secured to the lower end of the housing 60, and is provided with a centrally disposed axially extending post member 72 having a central passageway 74 into which a nozzle 76 is inserted. A capillary tube 78 is disposed within the cup member 70 and has one end immersed in a reservoir 80 of the fuel delivered to the cup 70 through the conduit 56. The opposite end of the capillary tube 78 terminates in an end piece 81 which is substantially centrally disposed within the interior of the cup 70 and which is supported in position by a suitable arm 82 secured to the post 72.

The nozzle 76 is in communication with a suitable source of pressurized air through a conduit 84, and the flow stream emerging from the nozzle 76 at a high velocity will cause the induction of fluid from the reservoir 80, through the tube 78, and through the open outer end of the end piece 81, where it will be picked up by the high velocity air stream 86 and caused to impinge at high velocity against a horizontally disposed cylindrical target member 88. The target 88 is carried by a chimney member 90 which is disposed substantially concentrically within the housing 60 and is supported therein by an outwardly extending circumferential flange 92 provided on the upper end of the chimney 90 which engages an inwardly directed annular shoulder 94 provided on the inner periphery of the housing 60. As the high velocity stream of fuel impinges against the target 88, the result is a breaking up of the droplets of the fuel stream into many very fine droplets or mist 96, which is then carried by the vertically rising air stream in accordance with the arrows 98, upwardly through the chimney 90 as shown by the arrow 100.

The flow stream in the vicinity of the arrow 100 carries very fine droplets and some larger droplets, and as the flow stream turns horizontally, as shown by the arrows 102, the larger droplets will fall from the stream by gravity and flow down the inner periphery of a sleeve 104 extending axially from the chimney 60. The falling droplets will return to the fuel reservoir 80. In the event some of the larger droplets fall outside of the sleeve 104, they will drop onto the flange 92 and will be directed into the interior of the sleeve 104 through a plurality of circumferentially spaced ports 106 provided in the walls of the sleeve, whereupon they will be directed into the reservoir 80.

The air flow from the air source 64 is drawn into the annular space 108 between the chimney 90 and housing 60, and into the interior of the chimney through the open bottom end thereof as indicated by the arrow 110. As the air stream moves upwardly through the chimney 90 and into the sleeve 104 with respect to the inner diameter of the chimney 60 creates a venturi action which results in a relatively high velocity of the air flow through the sleeve 104. This high velocity air stream will tend to carry the droplets away from the target area 88. Of course, as hereinbefore set forth, larger droplets will fall from the moving flow stream by gravity as the flow stream turns to the horizontal at the top of the sleeve 104, and the air stream with the fine mist of small droplets will move horizontally through the pipe 58 and into the open end 20 of the bore 18. In this manner, an air-fuel mixture of a desirable ratio, and wherein the fuel is broken into a fine mist will be moved through the bore 18 for passage to the intake manifold and into the combustion chamber for burning as is well known.

The source of pressurized air entering the conduit 84 may be the exhaust gases of the engine (not shown) itself, if desired, in which event it is desirable to provide a suitable check valve 112 for precluding reverse flow of the exhaust stream. Alternatively, the source of pressurized air for the conduit 84 may be a suitable air compressor 114 in communication with the conduit 84 through a suitable check valve 116.

Whereas it may be possible to eliminate the adjustor 46 which is normally provided in the carburetor 16 for adjustment of the flow of raw fuel into the bore 18 for idling speeds of the engine, it may be desirable to keep this adjustment for its normal operation. When the air-fuel nixture is drawn into the bore 18 by the suction created during the downstroke of as engine piston, the pressure generated at the passageway 38 draws a supply of fuel from the reservoir 30, whereupon the supply of fuel drops through the passageway 40 by gravity and may be discharged into the bore 18 through the ports 42 and 44, as is well known.

The operation of the carburetor 16 is substantially the normal or well known operation wherein the fuel-air mixture from the nebulizer 14 is drawn into the bore 18 by the suction created during the downstroke of an engine piston, and the fuel-air mixture is of a proper air to fuel ratio, and the fuel is substantially completely vaporized, or at least in such a fine mist state that the combustion of the fuel is greatly improved. In fact, during testing operations, particle output was measured in the 0.5 to 10.0 micra range. The output of the liquid tower carburetor per cubic foot of air is considerably greater than the output of ultrasonic apparatus, or other devices of this nature similarly tested. However, total fuel consumption was much lower when the liquid tower was used versus the ultrasonic. For example, the following table illustrates the results of a testing operation with the device of the invention:

| | Vapor Tower | Ultrasonic |
|---|---|---|
| Consumption of Fuel Per Minute | 1.2 cc | 6.0 cc |
| Output of particles 0.5 to 10.0 Micra per Cubic Foot | 28,000,000 plus | 10,000,000 plus |

From the foregoing it will be apparent that the present invention provides a novel liquid tower carburetor wherein the fuel is nebulized prior to injection thereof into the bore of the carburetor. The resultant air-fuel mixture is of an optimum ratio and the fuel is of a fine mist for producing increased fuel efficiency and reduced emissions because of the greater amount of the fuel which is burned during the combustion process.

Whereas the present invention has been described in particular relation to the drawings attached hereto, it should be understood that other and further modifications, apart from those shown or suggested herein may be made within the spirit and scope of this invention.

What is claimed is:

1. A liquid tower carburetor for an internal combustion engine and comprising a nebulizer section, a carburetor having a fuel reservoir for receiving a fuel therein and being in communication with one portion of the nebulizer sections and a carburetor barrel in communication with another portion of the nebulizer section whereby the fuel is drawn from the carburetor fuel reservoir into the nebulizer section, nozzle means provided in the nebulizer section for discharging a high pressure air stream thereto for pulling the fuel into the nebulizer section, passageway means introducing a second high pressure air stream into the nebulizer section for atomization of the fuel and directing the atomized fuel through the carburetor barrel and into the carburetor for delivery from the carburetor in the usual manner.

2. A liquid tower carburetor as set forth in claim 1 wherein the nebulizer section comprises housing means having the lower portion thereof in communication with the fuel reservoir for receiving the fuel supply therein, the nozzle means being disposed within said housing and open to the interior thereof at a position spaced above the surface of the fuel therein, capillary tube means disposed within the lower portion of the housing and having one open end emersed within the fuel therein and the opposite end open to the interior of the housing in the proximity of the open end of the nozzle means whereby fuel is drawn through the capillary tube upon the ejecting of fluid from the nozzle, chimney means supported within said housing and having the opposite ends thereof open whereby the fuel stream moves upwardly therethrough, target means carried by the chimney means and disposed in the path of the fuel stream for breaking the stream into relatively small particles, said second air supply means being in communication with the interior of the housing and chimney means and responsive to pressure differentials within said chimney means for mixing with the fuel stream therein, and said chimney means being in communication with the carburetor barrel of the carburetor for directing the fuel-air stream into the bore for discharge therefrom in the usual manner.

3. A liquid tower carburetor as set forth in claim 2 and including a source of pressurized fluid in communication with the nozzle means.

4. A liquid tower carburetor as set forth in claim 3 wherein said source is an air compressor.

5. A liquid tower carburetor as set forth in claim 3 wherein the source of said second pressurized fluid is the exhaust gas stream from the internal combustion engine.

6. A method of providing fuel for an internal combustion engine which comprises providing a fuel reservoir, providing a bore in communication with the internal combustion engine, directing fuel from the reservoir into the interior of a nebulizer, introducing a first high pressure air stream into the nebulizer, producing a venturi effect by the introduction of the first high pressure air stream for drawing the fuel into the interior of the nebulizer in a high velocity stream, breaking the high velocity stream into relatively small particles, introducing a second high velocity air stream into the proximity of the high velocity fuel stream for mixing of the air with the fuel to provide an atomized fuel stream, and utilizing the second high velocity air stream to facilitate direction of the atomized fuel stream through the bore and into the engine for combustion.

7. A method of providing fuel for an internal combustion engine as set forth in claim 6 and including the step of removing any relatively large particles from the high velocity stream prior to movement of the atomized fuel stream through the bore.

8. A method of providing fuel for an internal combustion engine as set forth in claim 6 and including the step of using the exhaust gas of the engine as the second air stream for injecting the fuel into the interior of the nebulizer.

9. A method of providing fuel for an internal combustion engine as set forth in claim 6 and including the step of using compressed air as the second air stream for injecting the fuel into the interior of the nebulizer.

10. A method of providing fuel for an internal combustion engine which comprises the steps of connecting the fuel reservoir of a carburetor with the lower portion of a nebulizer, connecting the intake end of the intake manifold of the carburetor with the upper portion of the nebulizer, injecting air into the nebulizer upon demand from the carburetor to siphon fuel from the fuel reservoir and into the nebulizer and simultaneously siphon air into the nebulizer for providing a preselected air-fuel ratio and atomizing the fuel in the nebulizer, and directing the atomized fuel into the intake end of the intake manifold for discharge from the carburetor into the engine in the usual manner.

11. A method of providing fuel for an internal combustion engine as set forth in claim 10 and including the steps of impacting the fuel against an immovable surface to break the fuel into fine particles of liquid, and precluding bypassing of the nebulizer by the injected air.

* * * * *